United States Patent [19]

Sander et al.

[11] 4,099,471

[45] Jul. 11, 1978

[54] APPARATUS FOR CLEANING THE AIR NOZZLES AND REGULATING AIR FLOW THERETO IN CHEMICAL RECOVERY BOILERS

[75] Inventors: Georg Sander; Sven Eric Jacobson; Åke Magnus Ivar Ericson, all of Jarfalla, Sweden

[73] Assignee: Combustion Engineering, Inc., Windsor, Conn.

[21] Appl. No.: 743,442

[22] Filed: Nov. 19, 1976

[30] Foreign Application Priority Data

Nov. 24, 1975 [SE] Sweden ..... 7513171

[51] Int. Cl.[2] ..... F23L 5/00

[52] U.S. Cl. ..... 110/182.5; 122/6.6; 122/379

[58] Field of Search ..... 122/6.6, 235 B, 379; 110/182.5

[56] References Cited

U.S. PATENT DOCUMENTS

| | | | |
|---|---|---|---|
| 3,742,916 | 7/1973 | Wessberg | 110/182.5 |
| 3,875,904 | 4/1975 | Astrom | 110/182.5 |
| 3,900,011 | 8/1975 | Stenlund | 110/182.5 |
| 3,943,861 | 3/1976 | Astrom et al. | 110/182.5 |
| 4,027,604 | 6/1977 | Jansson | 110/182.5 |

*Primary Examiner*—Kenneth W. Sprague
*Attorney, Agent, or Firm*—Robert L. Olson

[57] ABSTRACT

Apparatus for cleaning the air nozzles of a chemical recovery boiler, including a scraping sleeve slidable back and forth in the nozzle for removing built-up deposits. Also included is an air damper for regulating air flow to the nozzle.

2 Claims, 4 Drawing Figures

APPARATUS FOR CLEANING THE AIR NOZZLES AND REGULATING AIR FLOW THERETO IN CHEMICAL RECOVERY BOILERS

BACKGROUND OF THE INVENTION

Scraping sleeves for keeping the air nozzles clean in a chemical recovery boiler have been used in the past. However, there have been two types of problems associated with the previous arrangements. One, it has been difficult to prevent the sleeves from becoming jammed during operation. And secondly, there has been no suitable damper arrangement for controlling air flow to the plurality of nozzles so that the flow through each nozzle is the same.

SUMMARY OF THE INVENTION

Scraping sleeves are provided for the air nozzles of a chemical recovery unit, in accordance with the invention, with each sleeve having an adjustable sliding block which spaces the sleeve somewhat from the inner walls of the nozzle, thus preventing the sleeve from jamming during operation. The apparatus also includes a damper arrangement for regulating the air flow to the nozzles so that the flow through each nozzle is the same.

DESCRIPTION OF THE PREFERRED EMBODIMENTS

Figure 1:
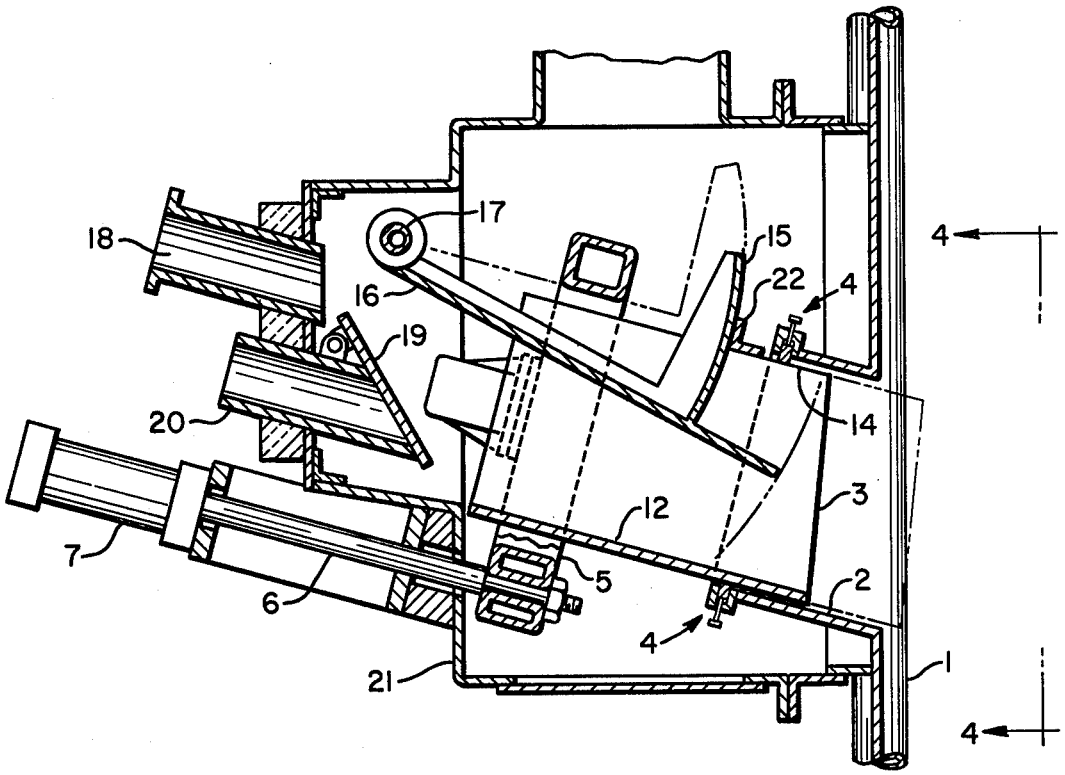
FIG. 1 is a schematic longitudinal section of the wall of a chemical recovery boiler.
Figure 4:
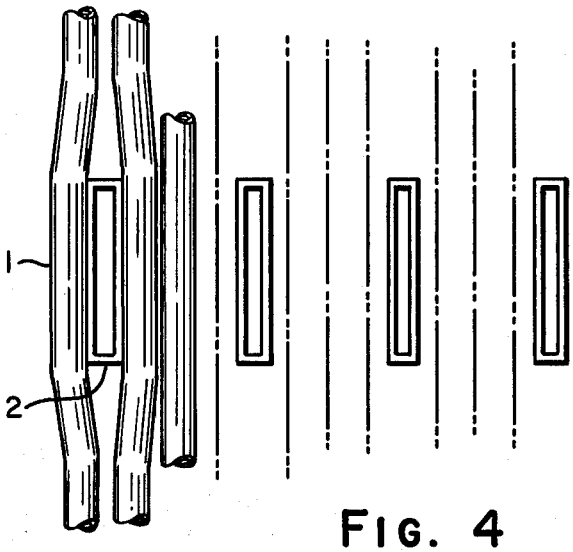
FIG. 4 is a schematic view taken on line 4—4 of FIG. 1.

Looking now to FIGS. 1 and 4, numeral 1 denotes tubes which make up the furnace wall of a chemical recovery boiler. At certain points, these tubes are bent apart so that nozzles 2 are introduced in the openings formed between the bent tubes. See also FIG. 4. The nozzles have a rectangular cross-section and extend from the furnace wall obliquely upward and outward as shown in FIG. 1. A scraping sleeve 3 is provided in nozzle 2 in order to perform a forward and backward motion within the nozzles. Slag deposits which form in the opening of the nozzles 2 can be removed by the forward and backward motion of the scraping sleeve 3. The slag deposit in the nozzle opening would otherwise lead to complete plugging of the nozzles, so that the air feed to the furnace would be stopped. In previous arrangements, the scraping sleeve extended within the nozzle 2, but since the sleeve was relatively short, and it jammed easily, so that forward and backward movements were prevented or were made considerably more difficult.

Figure 3:
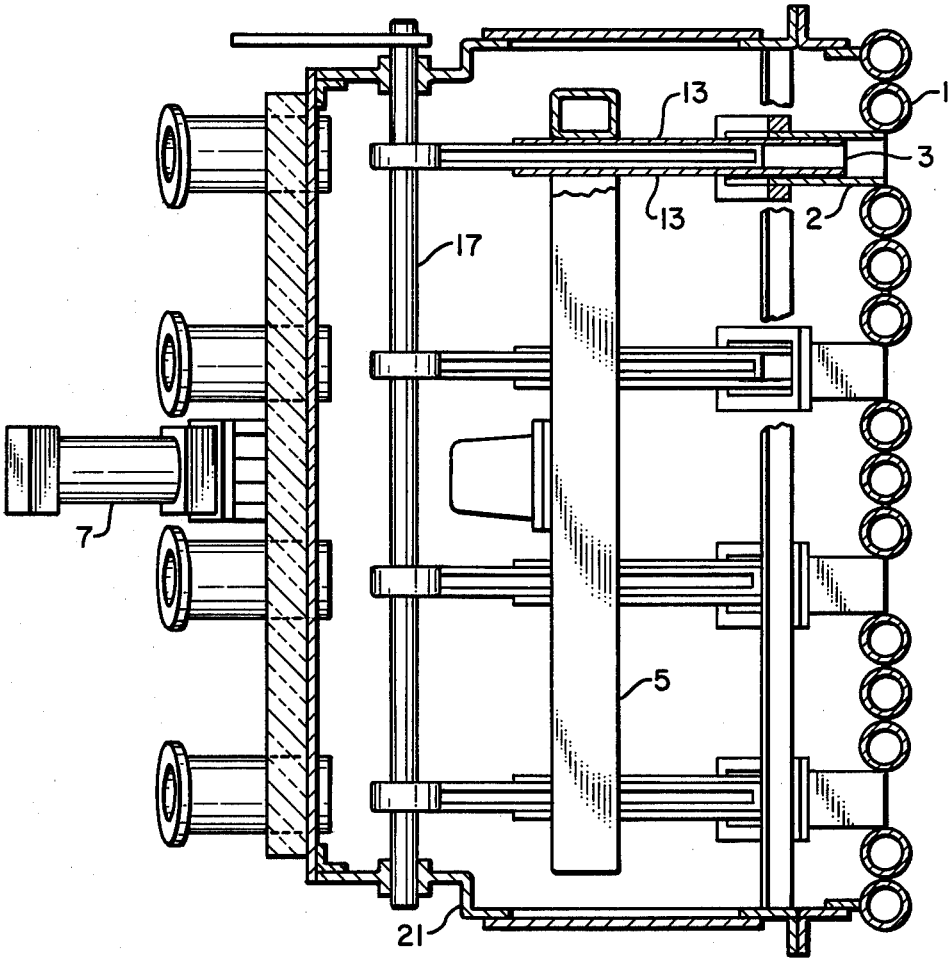
FIG. 3 is a schematic cross-section of four air nozzles with scraping sleeves constructed in accordance with the invention.

According to the invention, the scraping sleeve 3 is supported in nozzle 2 by an adjustable sliding support 4 and this sliding support is arranged against the sides of the scraping sleeve 3 on all four sides. The scraping sleeve 3 is supported at its outer end by an arrangement which can be moved in the forward and backward direction and which preferably consists of a frame which encloses the scraping sleeve and, as shown in FIG. 3, encloses four scraping sleeves arranged side-by-side. Arm 5 is conducted forward and backward by being connected to the end of a piston rod 6 connected to a hydraulic motor 7. Because the sliding support 4 is adjustable, the sliding path for the scraping sleeve 3 can be adjusted; i.e., so that a small but nevertheless reliable clearance is provided between the outside of the scraping sleeve 3 and the inside of nozzle 2 which eliminates jamming between the scraping sleeve and the nozzle.

Figure 2:
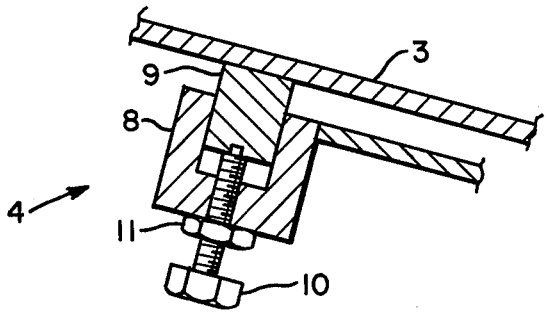
FIG. 2 is an enlarged view of one of the adjustable sliding blocks shown in FIG. 1.

In the versions of the sliding support shown in FIGS. 1 and 2, this consists of a frame 8 surrounding nozzle 2 in which sliding block 9 which carries scraping sleeve 3 is located. The sliding block 9 can move perpendicular to the inside of nozzle 2 in a groove in frame 8 and the position of sliding block 9 is determined by a screw 10 which is fixed in sliding block 9 but can be turned relative to the sliding block 9 and extends through a threaded part 11 at frame 8. By turning screw 10, the sliding block 9 can thus be moved upward and downward in frame 8.

The sliding block 9 is preferably formed along the entire lower edge of nozzle 2 and the underside of scraping sleeve 3. A similar sliding support, but in the inverse position compared to that shown in FIG. 2 is placed between the top edge of nozzle 2 and the top side of scraping sleeve 3. A similar sliding support is also suitably placed on the sides of scraping sleeve 3.

Scraping sleeve 3 is suitably formed so that it has a bottom 12, sides 13 as well as a top 14. A slit or opening is formed on the top of the scraping sleeve through which a register can be moved downward or upward in order to shield a selected part of the cross-section of the scraping sleeve. In the versions shown, register or damper 15, which has a width corresponding to the inside width of scraping sleeve 3 and a height which can be somewhat smaller than the height of the scraping sleeve 3, is supported by an arm, the width of which corresponds to the inside width of scraping sleeve 3. Arm 16 can be pivoted around a horizontal spindle 17 located outside of scraping sleeve 3. Thus, the air is supplied through duct 18 and flows against the underside of arm 16 and further through scraping sleeve 3. Damper 15 prevents air from being fed through the open top side of scraping sleeve 3. Thus damper 15 is swung around spindle 17 and when fully open, arm 16 in principle is in line with the top side of scraping sleeve 3. In the fully closed position, arm 16 is swung down, so that its inside end rests against the bottom 12 of scraping sleeve 3. A pipe-fitting 20 covered by shutter 19, which can be opened, is provided for the possible introduction of a lance to remove heavier deposits of slag in the opening of nozzle 2.

As shown in FIG. 3, four nozzles with scraping sleeves are enclosed in a common enclosure 21 so that a common adjustment device can be provided for the damper 15 via spindle 17 and a common drive, as mentioned earlier, can also be provided for the forward and backward displacement of the scraping sleeve by means of piston motor 7 and arm 5.

The invention makes it possible to apply a forward and backward displacement with the scraping sleeve 3 at suitable intervals, so that slag formation in the mouth of the nozzle 2 will be removed. During this motion, damper 15 can be maintained in the adjusted position, so that it is not necessary to stop boiler operation or to modify the combustion conditions in the furnace by changing the air feed. As shown in FIG. 1, a stay 22 is provided at the top side of scraping sleeve 2 and following the top edge of nozzle 2 which covers the opening between damper 15 and the inside top edge of nozzle 2.

Variations can be made within the scope of the invention, especially with regard to the form of the sliding support 4 and arm 5 with the corresponding drive. Furthermore, damper 15 can be formed in a different way and thus, does not need to consist of a pivoting damper, as shown, but can consist of a sliding damper which is moved up or down through the open top of scraping sleeve 3. Such a damper, however, is not as advantageous from the standpoint of air regulation, since the air flow pattern becomes poorer behind such a register than a more streamlined register of the type shown in FIG. 1.

We claim:

1. In combination, walls forming a furnace, air passage means connected to the furnace through a nozzle, a scraping sleeve mounted within the passage means, said scraping sleeve being slightly smaller in cross section than the nozzle, means for moving the sleeve toward and away from the furnace, said nozzle having a sleeve support extending around the entire inner periphery of the nozzle, so as to have line contact with the scraping sleeve around its entire periphery, and damper means for regulating the air flow to the nozzle.

2. The combination set forth in claim 1, wherein the damper means is in the form of a blade pivotably mounted on a horizontal axis at its end furthest from the nozzle, with its other end movable through an arc extending from the bottom of the sleeve to the top of the sleeve, so as to regulate the air flow therethrough.

* * * * *